US011117010B2

(12) United States Patent
Gupta et al.

(10) Patent No.: US 11,117,010 B2
(45) Date of Patent: Sep. 14, 2021

(54) STRENGTH AND ENDURANCE TRAINING SYSTEM

(71) Applicant: Purdue Research Foundation, West Lafayette, IN (US)

(72) Inventors: Ateev Gupta, San Francisco, CA (US); Casey Allen Abell, North Augusta, SC (US); Caitlin McCann Feltner, Novi, MI (US); Madeline Arnold, Edmonds, WA (US); Lindsey Grace Johnson, Indianapolis, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

(21) Appl. No.: 16/013,645

(22) Filed: Jun. 20, 2018

(65) Prior Publication Data

US 2018/0361189 A1 Dec. 20, 2018

Related U.S. Application Data

(60) Provisional application No. 62/522,427, filed on Jun. 20, 2017.

(51) Int. Cl.
*A63B 24/00* (2006.01)
*A63B 21/005* (2006.01)
(Continued)

(52) U.S. Cl.
CPC .... *A63B 21/00181* (2013.01); *A63B 21/0058* (2013.01); *A63B 21/08* (2013.01);
(Continued)

(58) Field of Classification Search
CPC ..... A63B 21/00181; A63B 21/08; A63B 21/0058; A63B 21/4001; A63B 21/153;
(Continued)

(56) References Cited

U.S. PATENT DOCUMENTS 4,948,118 A * 8/1990 Miraglia ..... A61H 3/008 104/62
4,948,119 A 8/1990 Robertson, Jr.
(Continued)

*Primary Examiner* — Garrett K Atkinson
*Assistant Examiner* — Zachary T Moore
(74) *Attorney, Agent, or Firm* — Piroozi-IP, LLC

(57) ABSTRACT

A strength and endurance training system. The system includes a first assist-resist system, which includes a first motor that is activated and deactivated by a first motor controller, a first drum coupled to the first motor, a first connecting member provided between the first drum and a coupling device which is attachable to an object/individual, and a computer system configured to use as input one or more of i) a measurement of distance of the coupling device form the first assist-resist system, ii) a predetermined strength value, and iii) a measurement of external force applied to the coupling device by the individual and thus operate the first assist-resist system in one of i) a resistive mode, wherein a resistive force is applied to the coupling device when the coupling device moves away from the first assist-resist system, ii) an assistive mode, wherein an assistive force is applied to the coupling device when the coupling device moves towards the first assist-resist system, and iii) a bypass mode, wherein a negligible force (between about 0 N-about 5 N) is applied to the coupling device.

10 Claims, 10 Drawing Sheets

(51) Int. Cl.
*A63B 21/08* (2006.01)
*A63B 69/12* (2006.01)
*A63B 21/00* (2006.01)

(52) U.S. Cl.
CPC ..... *A63B 21/153* (2013.01); *A63B 21/4001* (2015.10); *A63B 24/0062* (2013.01); *A63B 24/0087* (2013.01); *A63B 69/12* (2013.01); *A63B 2024/0093* (2013.01); *A63B 2220/20* (2013.01); *A63B 2220/51* (2013.01); *A63B 2244/09* (2013.01); *A63B 2244/20* (2013.01)

(58) Field of Classification Search
CPC . A63B 69/12; A63B 24/0087; A63B 24/0062; A63B 2220/20; A63B 2220/51; A63B 2244/20; A63B 2244/09; A61G 7/1017; A61G 7/1015; A61G 7/1011; A61G 7/1042; A61G 7/1001; A61G 7/1049; A61H 3/008
USPC ..... 212/71; 414/921, 560
See application file for complete search history.

(56) References Cited

U.S. PATENT DOCUMENTS

| | | | | |
|---|---|---|---|---|
| 5,391,080 | A | 2/1995 | Bernacki et al. | |
| 5,813,945 | A | 9/1998 | Bernacki | |
| 5,938,565 | A | 8/1999 | Bernacki | |
| 7,883,450 | B2 * | 2/2011 | Hidler ..... | A61H 3/008 212/104 |
| 9,682,000 | B2 * | 6/2017 | Behnke ..... | A63B 24/0087 |
| 9,839,569 | B2 * | 12/2017 | Behnke ..... | A61G 7/1001 |
| 9,987,188 | B1 * | 6/2018 | Diao ..... | A61H 3/008 |
| 10,343,753 | B1 * | 7/2019 | Santa-Torres ..... | G08B 7/02 |
| 2013/0116604 | A1 * | 5/2013 | Morilla ..... | A61G 7/1015 601/33 |
| 2015/0290517 | A1 * | 10/2015 | Saleh ..... | A63B 69/12 434/254 |

* cited by examiner

STRENGTH AND ENDURANCE TRAINING SYSTEM

CROSS-REFERENCE TO RELATED APPLICATIONS

The present patent application is related to and claims the priority benefit of U.S. Provisional Patent Application Ser. No. 62/522,427 filed Jun. 20, 2017, the contents of which is hereby incorporated by reference in its entirety into the present disclosure.

TECHNICAL FIELD

The present disclosure generally relates to training devices, and in particular to systems designed for improving strength and endurance of individuals.

BACKGROUND

This section introduces aspects that may help facilitate a better understanding of the disclosure. Accordingly, these statements are to be read in this light and are not to be understood as admissions about what is or is not prior art.

An important concept in training of an individual in a sport-related activity is repeatability of the training routine with which the individual is trained. In most training exercises, both strength and endurance training programs are important. For those who are just beginning, returning, or continuing in a sport activity, the training program (whether strength or endurance) may require resistance and assistance. Prior art includes devices that produce resistance and assistance separately. For example, U.S. Pat. No. 5,813,945 to Bernacki and U.S. Pat. No. 5,391,080 to Bernacki et al., disclose such systems. Furthermore, in a system identified as POWER TOWER produced by TOTAL PERFORMANCE INC (seen at http://www.tpiswim.com/power-tower) a weight (e.g., a water bucket) is raised as a swimmer swims away from the system producing resistance, and then falls as the swimmer swims toward the system generating assistance. In each case, resistance can only be provided when the swimmer swims away from the system; and assistance can only be provided when the swimmer swims towards the system. This limitation creates challenges for both strength and endurance training. The same challenges also exist when an individual goes through a rehabilitation program, e.g., a physical therapy program after incurring an injury or a medical procedure.

Therefore, there is an unmet need for a novel approach to selectively modulate resistance and assistance instantaneously when training an individual in a sport-related activity or in a rehabilitation setting.

SUMMARY

A strength and endurance training system is disclosed. The system includes a first assist-resist system, which includes a first motor that is activated and deactivated by a first motor controller, a first drum coupled to the first motor, a first connecting member provided between the first drum and a coupling device which is attachable to an object/individual, and a computer system. The computer system is configured to use as input one or more of i) a measurement of distance of the coupling device form the first assist-resist system, ii) a predetermined strength value, and iii) a measurement of external force applied to the coupling device by the individual and thus operate the first assist-resist system in one of i) a resistive mode, wherein a resistive force is applied to the coupling device when the coupling device moves away from the first assist-resist system, ii) an assistive mode, wherein an assistive force is applied to the coupling device when the coupling device moves towards the first assist-resist system, and iii) a bypass mode, wherein a negligible force (between about 0 N and about 5 N) is applied to the coupling device.

A method of providing strength and endurance training is also disclosed. The method includes providing a first assist-resist force to a coupling device that is attachable to an object/individual by a first assist-resist system coupled to the coupling device via a first connecting member, and controlling the first assist-resist system by a computer system. The computer system is configured to use as input one or more of i) a measurement of distance of the coupling device form the first assist-resist system, ii) a predetermined strength value, and iii) a measurement of external force applied to the coupling device by the individual and thus operate the first assist-resist system in one of i) a resistive mode, wherein a resistive force is applied to the coupling device when the coupling device moves away from the first assist-resist system, ii) an assistive mode, wherein an assistive force is applied to the coupling device when the coupling device moves towards the first assist-resist system, and iii) a bypass mode, wherein a negligible force (between about 0 N and about 5 N) is applied to the coupling device.

DETAILED DESCRIPTION

Figure 1:
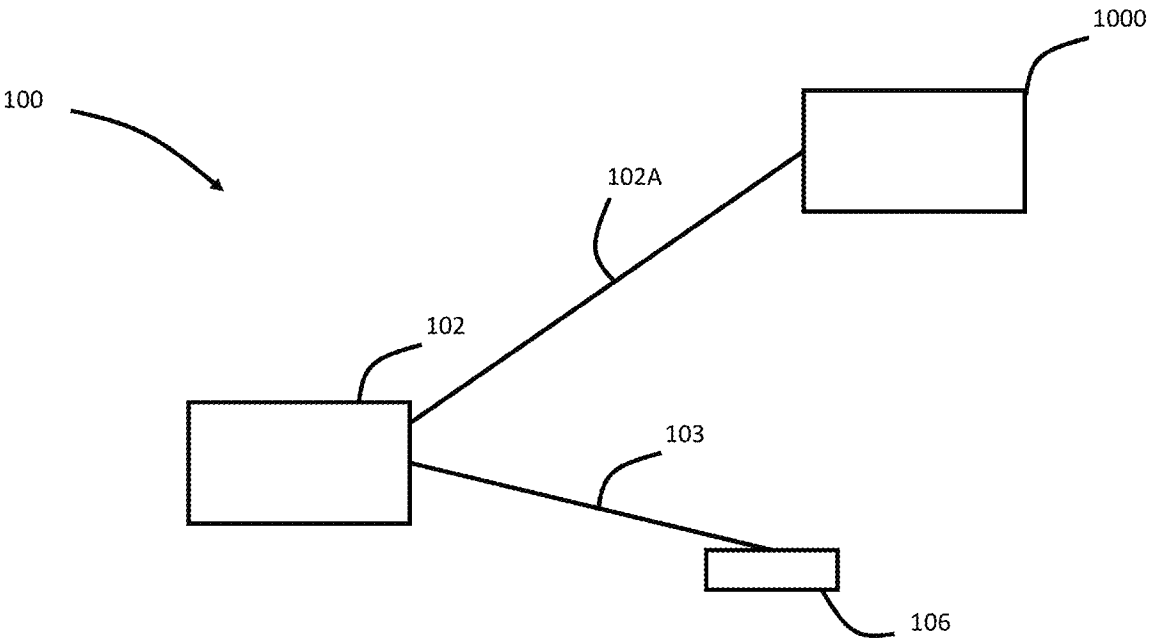
FIG. 1 is a block diagram schematic of a strength and endurance training system, according to one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

In the present disclosure, the term "about" can allow for a degree of variability in a value or range, for example, within 10%, within 5%, or within 1% of a stated value or of a stated limit of a range.

In the present disclosure, the term "substantially" can allow for a degree of variability in a value or range, for example, within 90%, within 95%, or within 99% of a stated value or of a stated limit of a range.

A novel approach to selectively modulate resistance and assistance instantaneously when training an individual in a sport-related activity or in a rehabilitation setting is disclosed. Referring to FIG. 1, a schematic of a training system 100 according to the present disclosure is depicted. The training system 100 includes a first assist-resist system 102 coupled to a coupling device 106 via a connecting member 103 (e.g., a rope, cable, chain and the like, also referred to as an extension member). A computer system 1000 (discussed with reference to FIG. 10, below), also referred to as a data-processing system 1000, is also depicted in FIG. 1. The computer system 1000 is coupled to the first assist-resist system 102 via a connectivity 102A. The connectivity 102A between the computer system 1000 and the first assist-resist system 102 is any one or more of a wired connection or wireless connection collectively including an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM, or other cellular modalities, and other connectivities known to a person having ordinary skill in the art. The computer system 1000 is capable of controlling the first assist-resist system 102. In the embodiment shown in FIG. 1, the computer system controls the operation of the first assist-resist system 102 based on an algorithm that may include creating a resistance by maintaining a net tension force that faces away from the first assist-resist system 102 while the coupling device 106 is moving away from the first assist-resist system 102 and then providing assistance by maintaining a net tension force that faces the first assist-resist system 102 while the coupling device 106 is moving towards the first assist-resist system 102.

When the training system 100 is running, there are generally three modes: 1) the first assist-resist system 102 is in the resist mode (i.e., providing a net force on the connecting member 103 that faces away from the first assist-resist system 102 when the coupling device 106 is moving away from the first assist-resist system 102); 2) the first assist-resist system 102 is in the assist mode (i.e., providing a net force on the connecting member 103 that faces towards the first assist-resist system 102 when the coupling device 106 is moving towards the first assist-resist system 102); and 3) the first assist-resist system 102 is in the standby mode (i.e., the standby mode is defined when the first assist-resist system 102 reeling or unreeling the connecting member without placing any substantial forces on the connecting member 103). It should be appreciated that the training system 100 cannot be in the assist mode when the coupling device 106 is moving away from the first assist-resist system 102. Similarly, it should be appreciated that the training system 100 cannot be in the resist mode when the coupling device 106 is moving towards the first assist-resist system 102.

Figure 2:
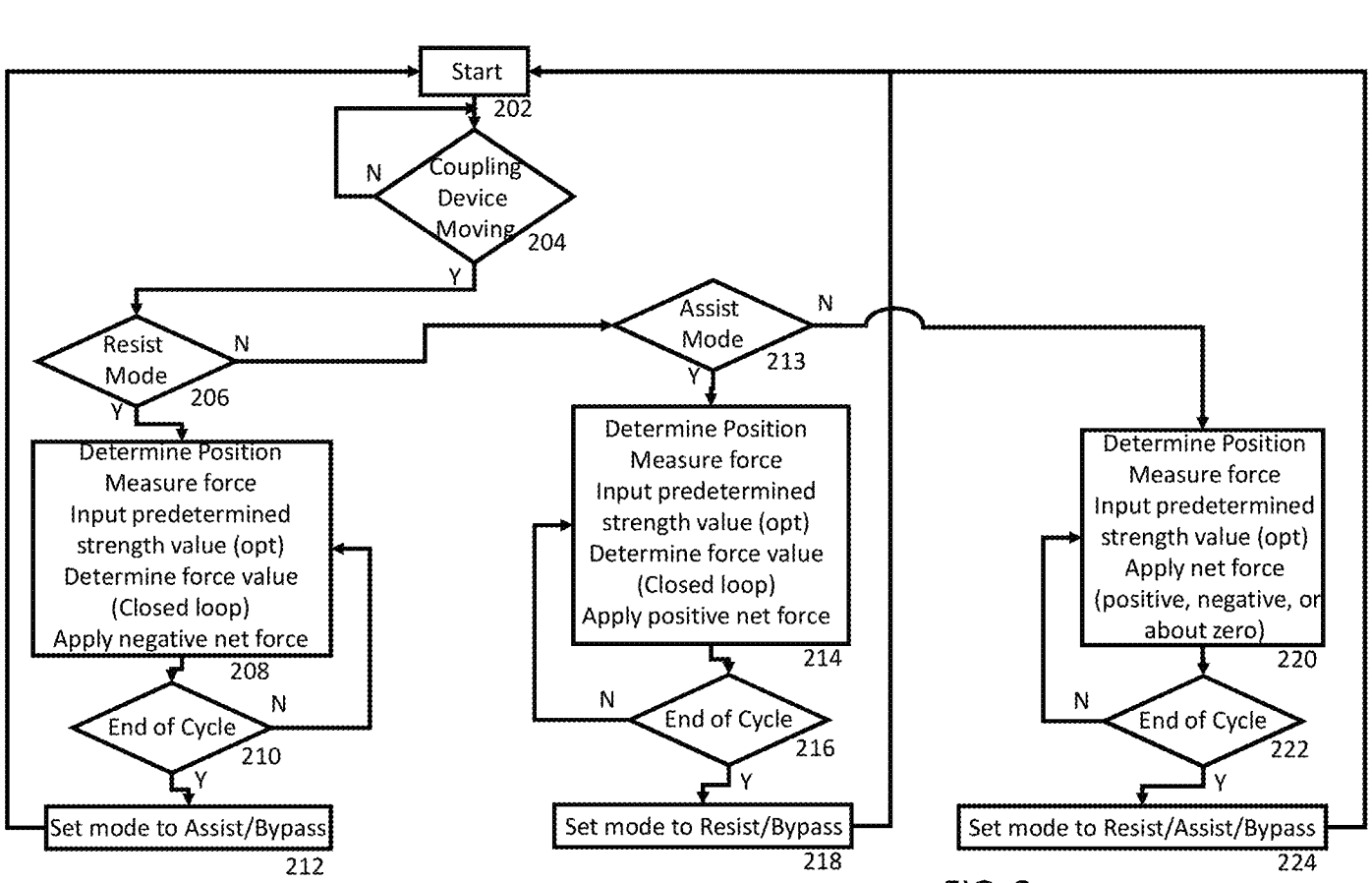
FIG. 2 is a flowchart diagram depicting the operation of the strength and endurance training system of FIG. 1.

Referring to FIG. 2, a flowchart 200 governing the operations of the training system 100 (shown in FIG. 1), according to one embodiment of the present disclosure, is depicted. The flowchart 200 begins at the start block 202. Immediately thereafter, in the decision block 204, the computer system 1000 determines whether the coupling device 106 (see FIG. 1) is moving. If the coupling device 106 is not moving, then the computer system 1000 returns to the start block 202. If the coupling device 106 is moving, then the computer system 1000 moves to the decision block 206 where it ascertains if the training system 100 (see FIG. 1) is in the resist mode (i.e., providing a negative net force on the connecting member 103—i.e., direction of the force faces away from the first assist-resist system 102—when the coupling device 106 is moving away from the first assist-resist system 102). If the first assist-resist system 102 (see FIG. 1) is in the resist mode, the computer system 1000 moves to the block 208 in which it ascertains position of the coupling device 106 (see FIG. 1) as an input, measures force as an input on the connecting member 103 (see FIG. 1), and optionally inputs parameters associated with strength training. The strength value as an input can be based on a lookup table held in memory (discussed below with reference to FIG. 10) or based on an algorithm. In each case, the strength value can be based on the location of the coupling device 106 (see FIG. 1) in the cycle of movement (e.g., a swimmer's position in the pool, or a weightlifter's position in a weightlifting exercise). For example, in an algorithmic approach, the strength value can be calculated based on a constant negative slope associating strength value to the position such that the strength value is the highest when the coupling device 106 (see FIG. 1) is at its initial position in the cycle, and is at its lowest when the coupling device 106 (see FIG. 1) is at its end position in the cycle. On the other hand, if the strength data is obtained from a lookup table held in memory (as discussed in reference to FIG. 10), then by knowing the position of the coupling device 106 (see FIG. 1) in the cycle and the timestamp, the desired strength value can be ascertained. In response to these inputs, the computer system 1000 (see FIG. 1) calculates the negative net force needed in the block 208, and then applies the negative net force to the connecting member 103 (see FIG. 1). Next in the decision block 210, the computer system 1000 (see FIG. 1) ascertains whether the end of the cycle has been reached. If not, the computer system 1000 (see FIG. 1) returns to the block 208. If the computer 1000 (see FIG. 1) determines the coupling device has reached the end of the cycle in the decision block 210, it moves to the block 212 where it sets the mode to assist or bypass (throughout the present disclosure the term bypass and standby are used interchangeably and are intended to refer to the same state of operation). Thereafter, the computer system 1000 (see FIG. 1), moves to start block 202.

Returning to the decision block 206, if the computer system 1000 (see FIG. 1) determines the mode is not set to resist, then the flowchart traverses to the decision block 213 in which it ascertains whether the training system 100 (see FIG. 1) is in the assist mode (i.e., providing a positive net force on the connecting member 103—i.e., direction of the force faces towards the first assist-resist system 102—when the coupling device 106 is moving towards the first assist-resist system 102). The switch between the resist and the assist occurs in the last pass where the computer system 1000 (see FIG. 1) had determined the coupling device 106 (see FIG. 1) had reached the end of its cycle and thus set the mode to assist in the block 212), then the flowchart 200 traverses to the middle branch to the block 214 in which it ascertains position of the coupling device 106 (see FIG. 1) as an input, measures force as an input on the connecting member 103 (see FIG. 1), and optionally inputs parameters associated with strength training. As discussed above, the strength value as an input can be based on a lookup table held in memory (discussed below with reference to FIG. 10) or based on an algorithm. In each case, the strength value can be based on the location of the coupling device 106 (see FIG. 1) in the cycle of movement (e.g., a swimmer's position in the pool, or a weightlifter's position in a weightlifting exercise). For example, in an algorithmic approach, the strength value can be calculated based on a constant negative slope associating strength value to the position such that the strength value is the highest when the coupling device 106 (see FIG. 1) is at its initial position in the cycle, and is at its lowest when the coupling device 106 (see FIG. 1) is at its end position in the cycle. On the other hand, if the strength data is obtained from a lookup table held in memory (as discussed in reference to FIG. 10), then by knowing the position of the coupling device 106 (see FIG. 1) in the cycle and the timestamp, the desired strength value can be ascertained. In response to these inputs, the computer system 1000 (see FIG. 1) calculates the positive net force needed in the block 214 and applies that positive net force. Next in the decision block 216, the computer system 1000 (see FIG. 1) ascertains whether the end of the cycle has been reached. If not, the computer system 1000 (see FIG. 1) returns to the block 214. If the computer 1000 (see FIG. 1) determines the coupling device has reached the end of the cycle in the decision block 216, it moves to the block 218 where it sets the mode to resist or bypass. Thereafter, the computer system 1000 (see FIG. 1), moves back to start block 202.

Returning to the decision block 213, if the computer system 1000 (see FIG. 1) determines the mode is not set to assist and also not set to resist, then the flowchart traverses to the righthand branch in which it ascertains the training system 100 (see FIG. 1) is in the bypass mode (i.e., providing about a zero net force on the connecting member 103—some negligible force is needed to maintain the connecting member 103 from becoming slack). The switch between the resist/assist and the bypass mode occurs in the last pass where the computer system 1000 (see FIG. 1) had determined the coupling device 106 (see FIG. 1) had reached the end of its cycle and thus set the mode to bypass in the block 212 or 218), then the flowchart 200 traverses to the righthand branch to the block 220 in which it ascertains position of the coupling device 106 (see FIG. 1) as an input, measures force as an input on the connecting member 103 (see FIG. 1), and optionally inputs parameters associated with strength training. In response to these inputs, the computer system 1000 (see FIG. 1) places the training system 100 (see FIG. 1) in the bypass mode or if needed can apply instantaneous positive or negative forces depending on whether the coupling device 106 (see FIG. 1) is moving towards or away from the first assist-resist system 102, respectively. Next in the decision block 222, the computer system 1000 (see FIG. 1) ascertains whether the end of the cycle has been reached. If not, the computer system 1000 (see FIG. 1) returns to the block 220. If the computer 1000 (see FIG. 1) determines the coupling device has reached the end of the cycle in the decision block 222, it moves to the block 224 where it sets the mode to assist, resist, or bypass. Thereafter, the computer system 1000 (see FIG. 1), moves back to start block 202.

While instantaneous switching to standby mode is not shown in FIG. 2 in the resist and assist mode branches, it should be appreciated in either blocks 208 and or 214, the training system 100 may enter the standby mode for the first assist-resist system 102 based on the inputs. For example, if the computer system 1000 receives an input from a strength lookup table that requires neither assist nor resist, the computer system 1000 determines a substantially zero force to be applied to connecting member 103 (see FIG. 1), thereby entering the standby mode (defined when the first assist-resist system 102 is reeling or unreeling the connecting member without placing any substantial forces on the connecting member 103 or remaining stationary (see FIG. 1)) based on position and timestamp of the coupling device 106 (see FIG. 1).

Similarly, while instantaneous switching to resist and/or assist mode is not shown in FIG. 2 in the standby mode branch, it should be appreciated in the block 220, the training system 100 may instantaneously enter the assist/resist mode for the first assist-resist system 102 based on the inputs. For example, if the computer system 1000 receives an input from a strength lookup table that requires an instantaneous assist during a standby cycle, the computer system 1000 determines the appropriate force to be applied to connecting member 103 (see FIG. 1), thereby instantaneously entering the assist mode (defined as provided above) based on position and timestamp of the coupling device 106 (see FIG. 1). This switch from standby to activate for the first assist-resist system 102 may occur as part of strength training program or when the computer system 1000 recognizes the user of the training system 100 is struggling by not providing the necessary forces determined by measuring forces exerted by the coupling device 106 to overcome the forces generated by the first assist-resist systems 102.

Figure 3:
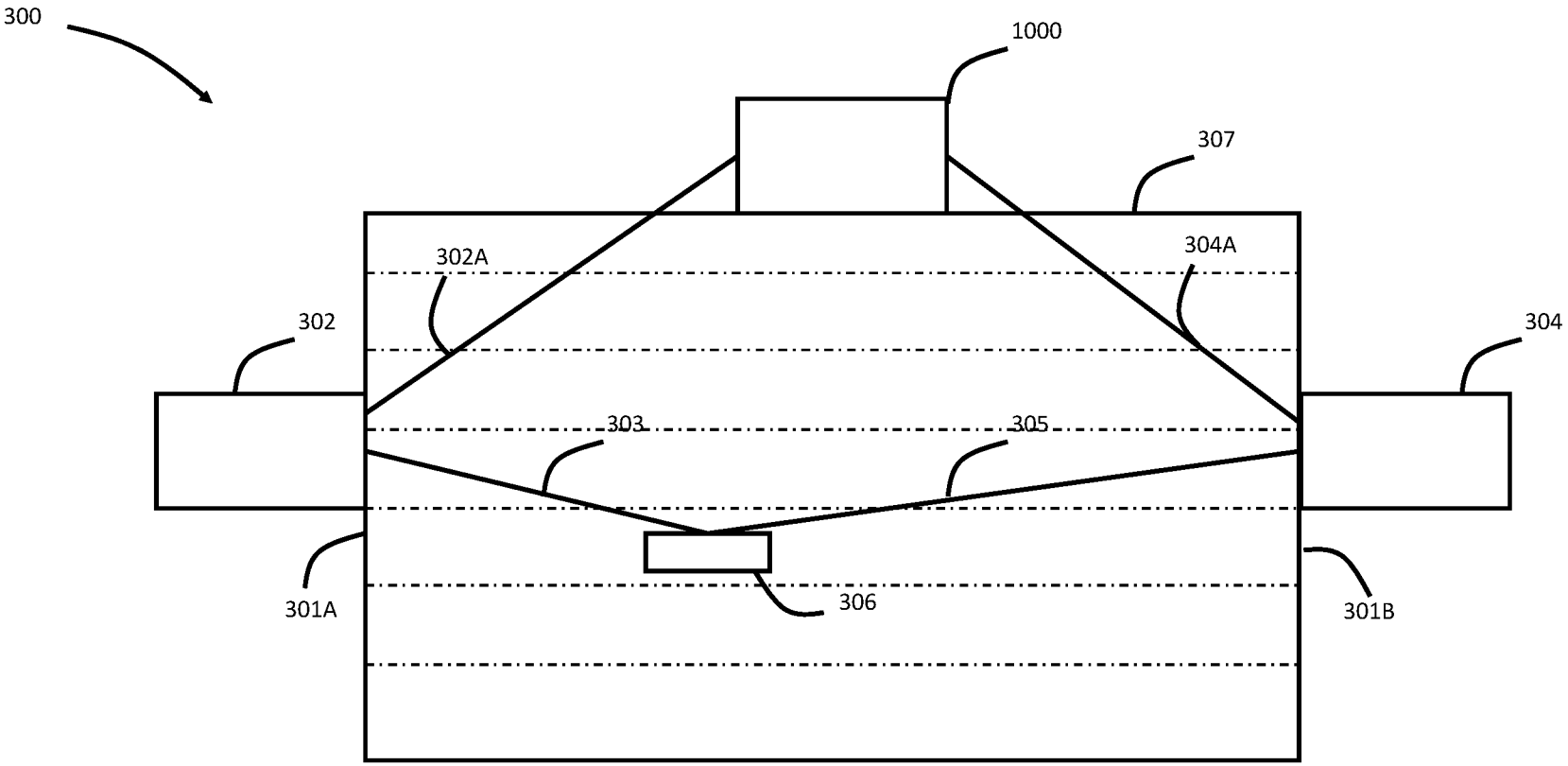
FIG. 3 is a block diagram schematic of a strength and endurance training system, according to another embodiment of the present disclosure.

Referring to FIG. 3, a schematic of another training system 300 according to the present disclosure is depicted. The training system 300 includes a first assist-resist system 302 positioned in a stationary manner at a first longitudinal end 301A of a swimming pool 307 and coupled to a coupling device 306 via a connecting member 303 (e.g., a rope, cable, chain and the like, also referred to as an extension member). The training system 300 also includes a second assist-resist system 304 positioned in a stationary manner at a first longitudinal end 301B of the swimming pool 307 and coupled to a coupling device 306 via a connecting member 305 (e.g., a rope, cable, chain and the like, also referred to as an extension member). A computer system 1000 (discussed with reference to FIG. 10, below), also referred to as a data-processing system 1000, is also depicted in FIG. 3. The computer system 1000 is coupled to the first assist-resist system 302 via a connectivity 302A, and to the second assist-resist system 304 via a connectivity 304A. The connectivity 302A,304A between the computer system 1000 and the first assist-resist system 302 and the second assist-resist system 304 are any one or more of a wired connection or wireless connection collectively including an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM, or other cellular modalities, and other connectivities known to a person having ordinary skill in the art. The computer system 1000 is capable of controlling the first assist-resist system 302 and the second assist-resist system 304. In the embodiment shown in FIG. 3, the computer system controls the operation of the first assist-resist system 302 and the second assist-resist system 304 based on an algorithm that may include, e.g., creating a resistance by maintaining a net tension force that faces away from the first assist-resist system 302 while the coupling device 306 is moving away from the first assist-resist system 302 and then providing assistance by maintaining a net tension force that faces the first assist-resist system 302 while the coupling device 306 is moving towards the first assist-resist system 302. With the addition of the second assist-resist system 304, the computer system 1000 can also instantly move from a resist mode to an assist mode, when, e.g., the coupling device 306 is moving away from the first assist-resist system 302 in which the algorithm is in the resist mode by operating the first assist-resist system 302 to cause a net tension force away from the first assist-resist system 302 while the second assist-resist system 304 is in a standby mode (i.e., simply reeling the connecting member 305 without placing any forces on the connecting member 305) to the assist mode by activating the second assist-resist system 304 such that there is a net force towards the second assist-resist system 304 while placing the first assist-resist system 302 in the standby mode (i.e., simply unreeling the connecting member 303 without placing any substantial forces on the connecting member 303). This switch from standby to activate for the second assist-resist system 304 at the same time of a switch from activate to standby for the first assist-resist system 302 may occur as part of strength training program or when the computer system 1000 recognizes the user of the training system 300 is struggling by not providing the necessary forces determined by measuring forces exerted by the coupling device 306 to overcome the forces generated by the first and second assist-resist systems 302,304.

When the training system 300 is running, there are generally three modes: 1) the first assist-resist system 302 is in the activate mode (i.e., either providing a resist while the coupling device 306 is moving away from the first assist-resist system 302—that is providing a net force on the connecting member 303 that faces away from the first assist-resist system 302, or providing an assist while the coupling device 306 is moving towards the first assist-resist system 302—that is providing a net force on the connecting member 303 that faces towards the first assist-resist system 302) while the second assist-resist system 304 is in the standby mode (as discussed above, the standby mode is defined when the associated first or second assist-resist systems 302,304 reeling or unreeling the associated connecting members 303,305 without placing any substantial forces on the associated connecting members 303,305); 2) both the first and second assist-resist systems 302,304 are in the standby mode; and 3) the second assist-resist system 304 is in the activate mode (i.e., either providing a resist while the coupling device 306 is moving away from the second assist-resist system 304—that is providing a net force on the connecting member 305 that faces away from the second assist-resist system 304, or providing an assist while the coupling device 306 is moving towards the second assist-resist system 304—that is providing a net force on the connecting member 305 that faces towards the second assist-resist system 304) while the first assist-resist system 302 is in the standby mode (as discussed above, the standby mode is defined when the associated first or second assist-resist systems 302,304 reeling or unreeling the associated connecting members 303,305 without placing any substantial forces on the associated connecting members 303,305).

Figure 4:
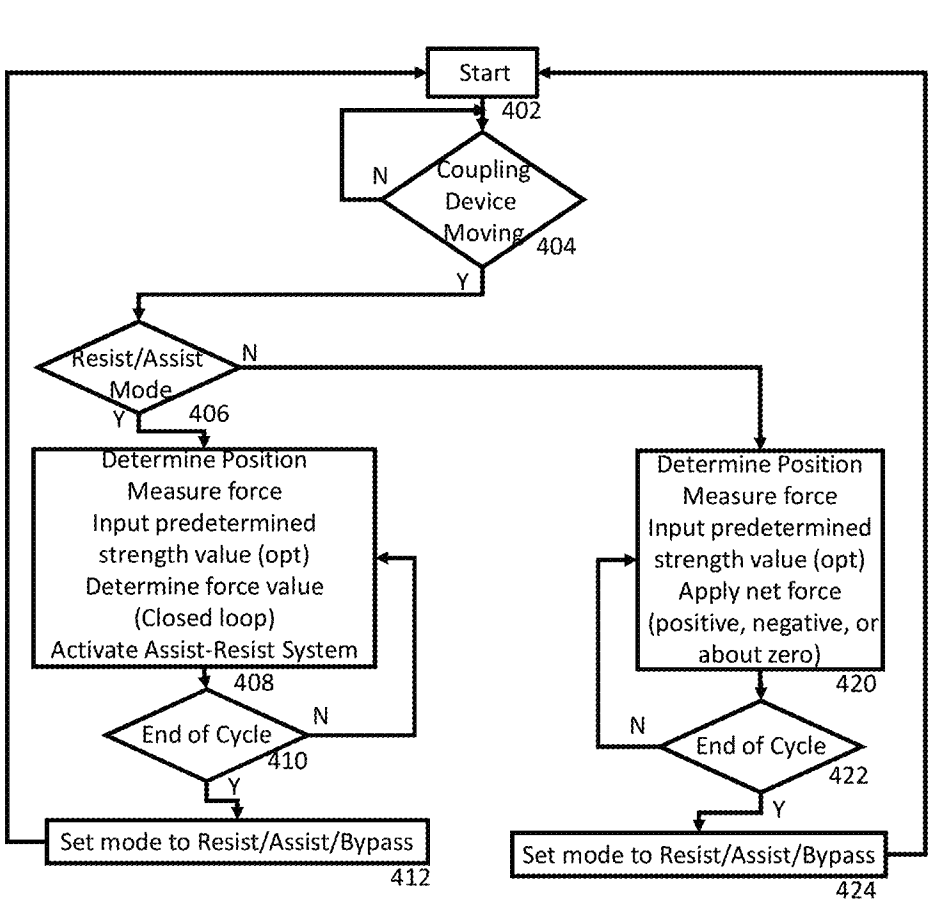
FIG. 4 is a flowchart diagram depicting the operation of the strength and endurance training system of FIG. 3.

Referring to FIG. 4, a flowchart 400 governing the operations of the training system 300 (shown in FIG. 3), according to one embodiment of the present disclosure, is depicted. The flowchart 400 begins at the start block 402. Immediately thereafter, in the decision block 404, the computer system 1000 determines whether the coupling device 306 (see FIG. 3) is moving. If the coupling device 306 is not moving, then the computer system 1000 returns to the start block 402. If the coupling device 306 is moving, then the computer system 1000 moves to the decision block 306 where it ascertains if the training system 300 (see FIG. 3) is in the resist/assist mode (see above for a description of these modes). If the first or second assist-resist system 302,304 (see FIG. 3) is in the resist/assist mode, the computer system 1000 moves to the block 408 in which it ascertains position of the coupling device 306 (see FIG. 3) as an input, measures force as an input on the connecting member 303 (see FIG. 3), and optionally inputs parameters associated with strength training. The strength value as an input can be based on a lookup table held in memory (discussed above) or based on an algorithm (discussed above). In each case, the strength value can be based on the location of the coupling device 306 (see FIG. 3) in the cycle of movement (e.g., a swimmer's position in the pool, or a weightlifter's position in a weightlifting exercise). In response to these inputs, the computer system 1000 (see FIG. 3) calculates the positive/negative net force needed in the block 408, and then applies the net force to the connecting member 303/305 (see FIG. 3). Next in the decision block 410, the computer system 1000 (see FIG. 3) ascertains whether the end of the cycle has been reached. If not, the computer system 1000 (see FIG. 3) returns to the block 408. If the computer 1000 (see FIG. 3) determines the coupling device has reached the end of the cycle in the decision block 410, it moves to the block 412 where it selectively sets the mode to resist/assist or bypass based on the strength algorithm or lookup table. Thereafter, the computer system 1000 (see FIG. 3), moves to start block 402.

Returning to the decision block 406, if the computer system 1000 (see FIG. 1) determines the mode is not set to assist/resist, then the flowchart traverses to the righthand branch in which it ascertains the training system 300 (see FIG. 3) is in the bypass mode (i.e., providing about a zero net force on the connecting members 303,305—some negligible force is needed to maintain the connecting members 303,305 from becoming slack). The switch between the resist/assist and the bypass mode occurs in the last pass where the computer system 1000 (see FIG. 3) had determined the coupling device 306 (see FIG. 3) had reached the end of its cycle and thus set the mode to bypass in the block 412), then the flowchart 400 traverses to the righthand branch to the block 420 in which it ascertains position of the coupling device 306 (see FIG. 3) as an input, measures force as an input on the connecting member 303,305 (see FIG. 3), and optionally inputs parameters associated with strength training. In response to these inputs, the computer system 1000 (see FIG. 3) places the training system 300 (see FIG. 3) in the bypass mode or if needed can apply instantaneous positive or negative forces depending on whether the coupling device 306 (see FIG. 3) is moving towards or away from the first-second assist-resist system 302,304 respectively. Next in the decision block 422, the computer system 1000 (see FIG. 3) ascertains whether the end of the cycle has been reached. If not, the computer system 1000 (see FIG. 3) returns to the block 420. If the computer 1000 (see FIG. 3) determines the coupling device has reached the end of the cycle in the decision block 422, it moves to the block 424 where it sets the mode to assist, resist, or bypass. Thereafter, the computer system 1000 (see FIG. 3), moves back to start block 402.

While instantaneous switching to standby mode is not shown in FIG. 4 in the resist/assist mode branch, it should be appreciated in the blocks 408, the training system 300 may enter the standby mode for the first-second assist-resist systems 302,304 (see FIG. 3) based on the inputs. For example, if the computer system 1000 receives an input from a strength lookup table that requires neither assist nor resist, the computer system 1000 determines a substantially zero force to be applied to connecting members 103,105 (see FIG. 3), thereby entering the standby mode (based on position and timestamp of the coupling device 306 (see FIG. 3).

Similarly, while instantaneous switching to resist and/or assist mode is not shown in FIG. 4 in the standby mode branch, it should be appreciated in the block 420, the training system 300 may instantaneously enter the assist/resist mode for the first-second assist-resist system 302,304 based on the inputs. For example, if the computer system 1000 receives an input from a strength lookup table that requires an instantaneous assist during a standby cycle, the computer system 1000 determines the appropriate force to be applied to connecting members 303,305 (see FIG. 3), thereby instantaneously entering the assist mode (defined as provided above) based on position and timestamp of the coupling device 306 (see FIG. 3).

In the embodiment shown in FIG. 3, the computer system 1000 controls the first-second assist-resist system 302,304 such that if one is actively pulling the other one is in the standby mode and thereby cooperate with each other to create selective modulation of resistance and assistance forces applied to the coupling device 306 (see FIG. 3). It should be noted that the coupling device 106 (see FIG. 1) or 306 (see FIG. 3) can be a harness worn by an individual, a bar for lifting weight on a bench or raised from the floor by a weight lifter (where the first assist-resist system 102 (see FIG. 1) or coupled to about opposite ends of the bar or handles, or other weight lifting or exercising coupling arrangements known to a person having ordinary skill in the art.

Figure 5:
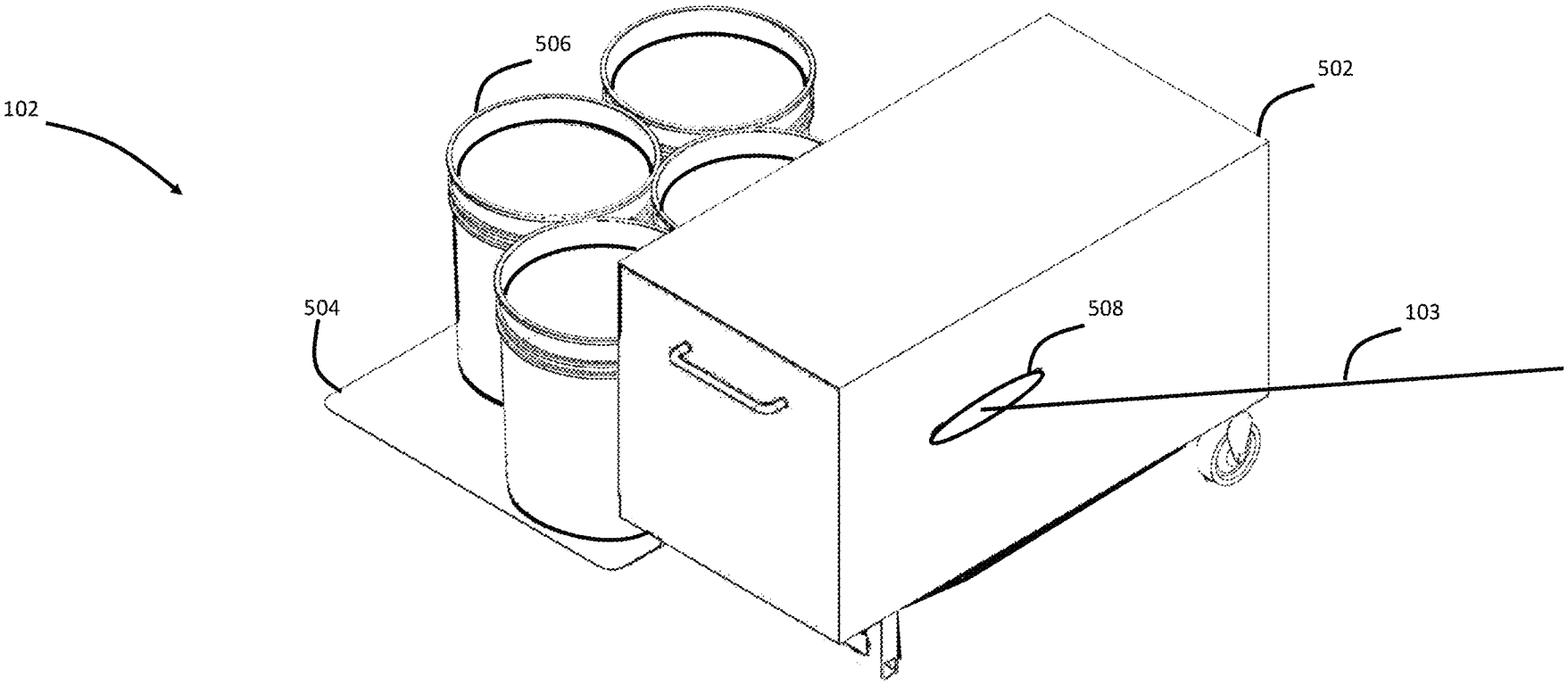
FIG. 5 is a perspective schematic of parts of the strength and endurance training systems of FIGS. 1 and 3.
Figure 6:
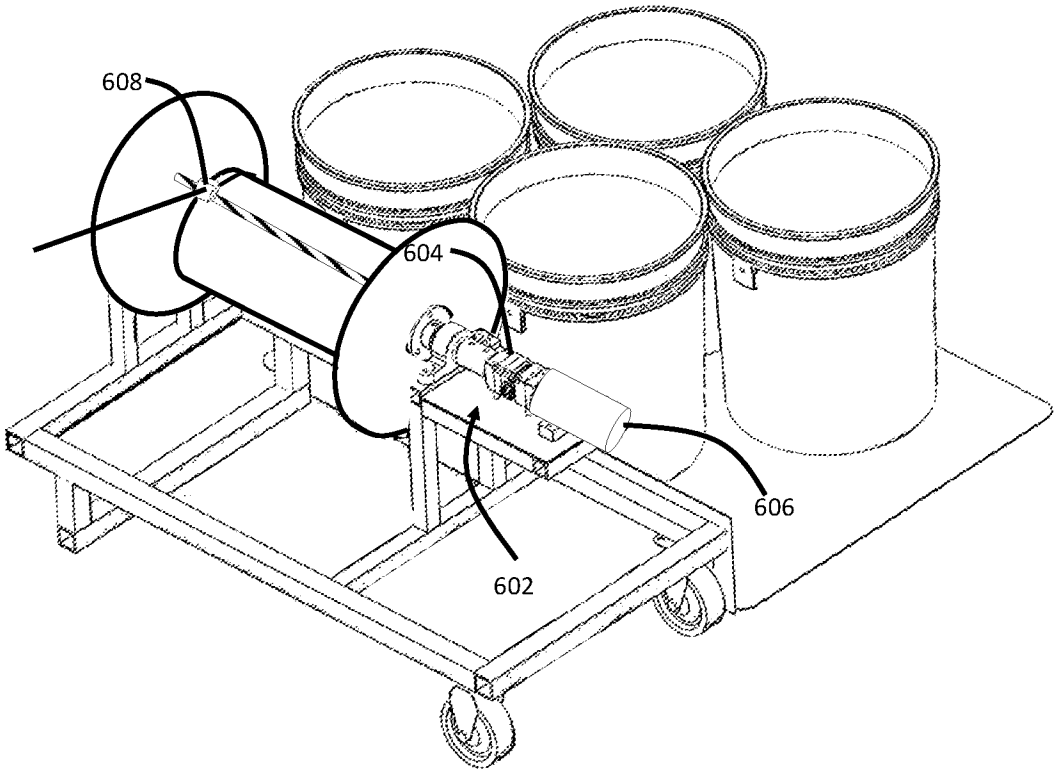
FIG. 6 is another perspective schematic of parts of the strength and endurance training systems of FIGS. 1 and 3.

Referring to FIG. 5, a perspective view of the first assist-resist system 102 (see FIG. 1), according to one embodiment of the present disclosure is shown. The description provided below for the first assist-resist system 102 (see FIG. 1) with respect to the following figures and the associated components also applies to the second assist-resist system 304 (see FIG. 3) and its associated components and in all cases the description is according to only the stated embodiments. The first assist-resist system 102 includes a housing 502 and anchor 504 to ensure the housing remains stationary during operations. The housing 502 is connected to the anchor 504. In the embodiment shown, the anchor 504 is held stationary utilizing 4 buckets 506 holding a fluid, e.g., water for weight. However, other approaches, such as bolts, screws, fasteners, and other anchoring mechanisms known to a person having ordinary skill in the art can also be used to couple the housing 502 to a surface to ensure the housing 502 remains stationary during operation. In the housing 502, there exist a slit or opening 508 through which the connecting member 103 (see FIG. 1) extends and which reaches to the coupling device 106. While not shown, in one embodiment the first assist-resist system 102 is capable of adjusting height of the connecting member 103 (see FIG. 1) in order to maintain an optimum angle between the first assist-resist system 102 and the coupling device 106. The first assist-resist system 102 includes a powertrain 602 which includes a transmission 604 and a motor 606 (depicted on the left hand side of FIG. 6 where the internal structure of the first assist-resist system 102 is depicted, according to one embodiment of the present disclosure). The powertrain 602 is adapted to apply a resistive force when the coupling device 106 is moving away from the first assist-resist system 102 or an assistive force when the coupling device 106 moves towards the first assist-resist system 102. The resistive force is applied via one of several approaches, including: 1) application of mechanical braking by engaging mechanical brakes to a shaft or a disc, or a drum, as is known to a person having ordinary skill in the art; 2) application of passive braking by engaging electrical energy consuming devices, e.g., resistors, by converting the motor and a motor driver (not shown) of the first assist-resist system 102 into a generator and converting the energy produced into heat; 3) application of energy recovery by engaging an electrical energy storage, e.g., batteries or capacitors, by converting the motor and a motor driver (not shown) of the first assist-resist system 102 into a generator and storing the energy produced; 4) application of energy recovery by engaging a mechanical energy storage, e.g., springs or an air compressing device, by converting the motor and a motor driver (not shown) of the first assist-resist system 102 into a generator and storing the energy produced; and 5) by applying electrical current to the motor of the first assist-resist system 102 in a direction that opposes the movement of a user of the training system 100 (see FIG. 1), i.e., a trainee.

Conversely, the assistive force is applied via one of several approaches, including: 1) by applying electrical current to the motor of the first assist-resist system 102 in a direction that assists the movement of the trainee, wherein the electrical current can be sourced from an electrical outlet, a battery, a capacitor, or other electrical storage devices known to a person having ordinary skill in the art; and 2) application of recovered mechanical energy by engaging a mechanical energy storage, e.g., springs or an air compressing device, to convert storage mechanical energy (stored during the resist mode).

The first assist-resist system 102 can be powered by AC electrical power from the wall in cases where such a power connection is available, or alternatively by a battery. As discussed above, the battery can be charged during the resistance mode by converting the motor into a generator.

The DC motor alone or in combination with friction braking can be used to generate resistance as well as respool the connecting member 103. Alternatively, for respooling the first assist-resist system 102 one can utilize constant torque springs that can be used to respool and at the same time providing assistive force. A barrel cam 608 (see FIG. 6) or fairway known to a person having ordinary skill in the art was used as alignment components which allow the connecting member 103 to align back onto the spool, in order to respool consistently and without tangles. In one embodiment, the barrel cam 608 (see FIG. 6) is powered by the motor using a step down mechanism, e.g., by utilizing gears, as is known to a person having ordinary skill in the art. Alternatively, the spool can be threaded with a passively moving slit in front of the spool such that by rotating the spool the connecting member 103 is forced to the same position on the spool whether during spooling or unspooling operation. In yet another embodiment, the spools may be outfitted with a screw-type thread for the connecting member 103 to be positioned into the threads. In this embodiment, the spool needs to have sufficient diameter and sufficient number of threads to allow all of the connecting member 103 to be reeled onto the spool with only one layer.

Since in one embodiment described above, the first assist-resist system 102 is based on a motor and accompanying electronics, any variation of friction, resistance, or inertia between units can be compensated for in the circuitry. The computer system 1000 is also able to provide to the trainees feedback on the activity including time, speed, peak force, average wattage and total energy.

Data sensing and feedback will be accomplished with a hall effect sensor or other speed sensing devices, e.g., variable reluctance sensor, etc., known to a person having ordinary skill in the art.

Figure 7:
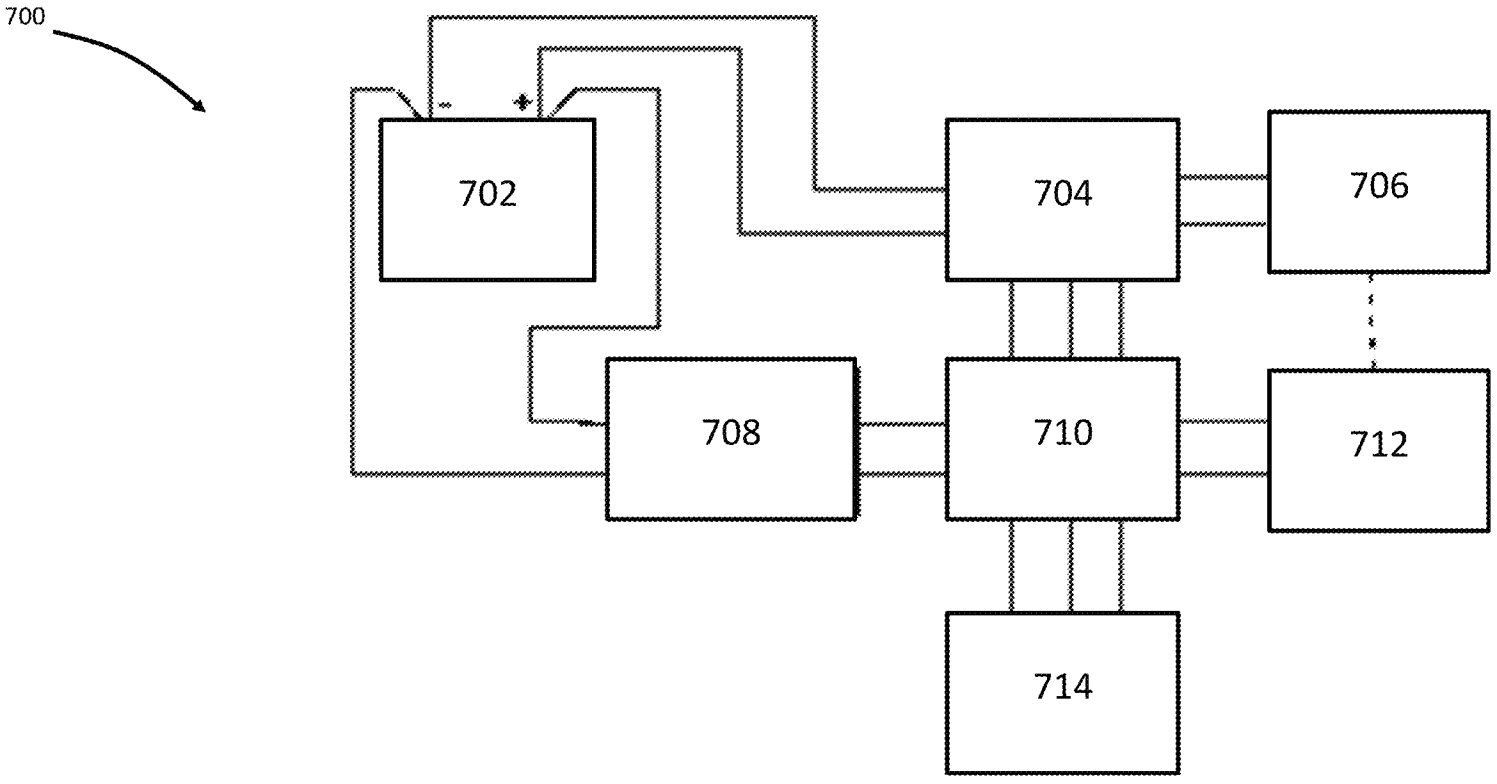
FIG. 7 is a block diagram schematic of control operation of the strength and endurance training systems of FIGS. 1 and 3.

Referring to FIG. 7, a block diagram 700 schematic of the first assist-resist system 102 is depicted. The block diagram 700 includes a power source 702 (this can be a battery for portability or AC power from a wall outlet), a motor drive 704 (this is the power electronic circuit designated to turn on and off a motor 706), the motor 706, a stepdown circuit to convert power from the power source 702 to a suitable level for electronics in a controller 710), the controller 710, an encoder designated to know the position of the coupling device 106, and an output device 714 (such as an LCD display for communication). The controller 710 is configured to provide an interface between the trainee, the motor, and a user (which could also be the trainee). The output device 714 provides a display of velocity and force measurements (average, peak, and instantaneous) recorded during the operation of the first assist-resist system 102. For the first assist-resist system 102, the operation is divided into two operating modes, resistance and assistance. In the embodiment where only the first assist-resist system 102 is used, during the resistance mode, the controller 710 activates or engages the motor drive 704 to accomplish the tasks discussed above with respect to FIG. 2. It should be appreciated that the controller 710 is in addition or part of the computer system 1000. Where the controller 710 is part of the computer system 1000, the controller 710 is also configured to accomplish other tasks in relationship to FIG. 10, described below. Where the controller 710 is in addition to the computer system 1000, other processing units discussed below provide communications with the controller 710. In one embodiment, the controller 710 is based on an ARDUINO development toolset. The controller 710 is further configured to record data from the encoder and a current sensor (e.g., an inline current sensing resistor, either in line with the passive energy-dissipative circuit or with the motor, and an operational amplifier coupled to the sensing resistor) or other mechanical sensing devices in cases of mechanical resistive forces to determine the resistance forces exerted on the trainee and velocity of the trainee. In the assistance mode, the controller 710 deactivates the resistive mechanism and engages the assistive mechanism as described above to provide an assist force to the trainee from about 0 N-about 5 N (the motor driver will operate in a constant torque mode adjusting speed to match the speed or force applied by the trainee) to a predetermined value of force being applied to the trainee (the upper limit is set with application of the training system 100; for example, in a swimming application the upper limit may be 100 N, however, in a weightlifting system, the upper limit may be much higher. Examples of such weightlifting systems include free weight systems, cable/pulley systems, and a variety of other weightlifting systems that can be augmented to provide the desired interactions between the first and second assist-resist systems 102, or 302,304 (see FIGS. 1 and 3). IN all these situations, the bulky weights can be replaced by the first and second assist-resist systems 102, or 302,304 thereby providing a more streamlined exercise, training, and rehabilitation environment as well as an infinite number of selective settings.

In the embodiment where both the first assist-resist system 302 and the second assist-resist system 304 (see FIG. 3) are used, during the resistance mode, each system's controller 710 (or alternatively a central controller) modulates between placing one of the associated systems in the resistive mode while placing the other pull system in a bypass mode to placing one of the two systems in the assistive mode while placing the other in the bypass mode, or alternatively placing both in the bypass mode.

In one embodiment, the motor 706 for the first assist-resist system 102 is a FR801-001 CIM brushed DC motor. The motor 706 features permanent magnets that create a stationary magnetic field to interact with the armature windings. This interaction is characterized by the constant $k_v$, the viscous damping coefficient for the motor is given by the variable $B_m$, the rotor velocity is given by $\omega_r$, the electromotive torque of the motor is given by $T_e$, the load torque on the motor is given by $T_L$, the resistance in the armature windings is given by $r_a$, the current through the armature windings is given by $I_a$, the voltage applied across the armature windings is given by $V_a$, the power input to the motor through electricity is given by $P_{in}$, the power output by the motor is given by $P_{out}$, the power lost in the armature windings is given by $P_{i2r}$, and the power lost through friction in the bearings and brushes is given by $P_{fw}$. The following equation gives the relationship between applied armature voltage, armature current, and counter-electromotive force assuming a negligible voltage drop across the inductor due to the change in current:

$$V_a=r_aI_a+k_v\omega_r$$

The relationship between motor output torque, load torque, and frictional losses in the motor is established by the following equation assuming a negligible inertial force:

$$T_e=B_m\omega_r+T_L$$

The electromotive torque of the equation is also proportional to the armature current:

$$T_e=k_vI_a$$

The power inputs, outputs, and losses are given below:

$$P_{in}=P_{i^2r}+P_{fw}+P_{out}$$

$$P_{in}=I_aV_a$$

$$P_{i^2r}=I_a^2r_a$$

$$P_{fw}=B_m\omega_r^2$$

$$P_{out}=T_L\omega_r$$

The above equations can then be used to find the performance constants of the motor given by $r_a$, $k_v$, and $B_m$. The following equations use the subscripts fl and s to denote free load and stall conditions respectively:

$$k_v=\frac{1}{\left(\frac{i_a fl}{\tau_e s}+\frac{\omega_{r,fl}}{V_a}\right)}=0.02107\frac{Vs}{\text{rad}}$$

$$B_m=\frac{k_vI_{a,fl}}{\omega_{r,fl}}=1.0233\times10^{-4}\frac{Nms}{\text{rad}}$$

$$r_a=\frac{k_vV_a}{T_{e,s}}=0.10429\ \Omega$$

Figure 8:
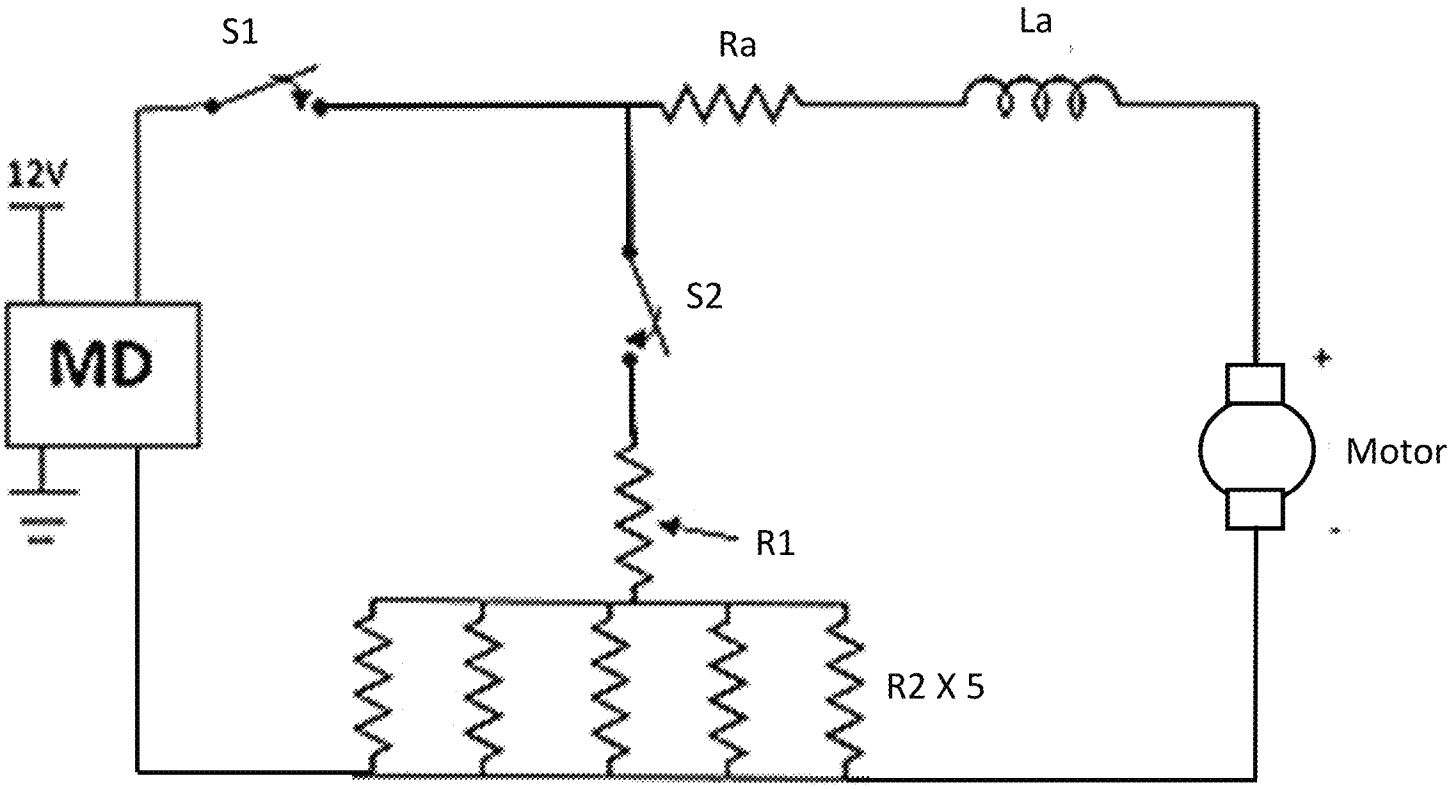
FIG. 8 is a circuit schematic of a controller for controlling a motor in the strength and endurance training systems of FIGS. 1 and 3 having a controllable variable resistance that can adjust output force.

Using the performance characteristics of the motor, it is possible to calculate current and velocity. To reach a viable load torque and motor speed, a 25:1 gearbox can be used, and to interface with the computer system 1000, a Pololu VNH5019 dual channel motor driver will be used. The current limit through the motor driver is set a continuous 24 A to 27 A (based on predetermined studies), so the motor driver would be capable of providing an active resistance to the trainee with a life expectancy tradeoff. To maximize the life expectancy of the product, a passive resistance system utilizes relays to isolate circuit paths. The dissipative path includes a potentiometer to adjust the resistance level and a bank of dissipative power resistors, and the alternate path will include the motor driver used to return the rope. Referring to FIG. 8, a schematic of the circuit for the motor drive 704 is shown. A resistor bank is shown with 5 resistors in the bank in FIG. 8.

Figure 9:
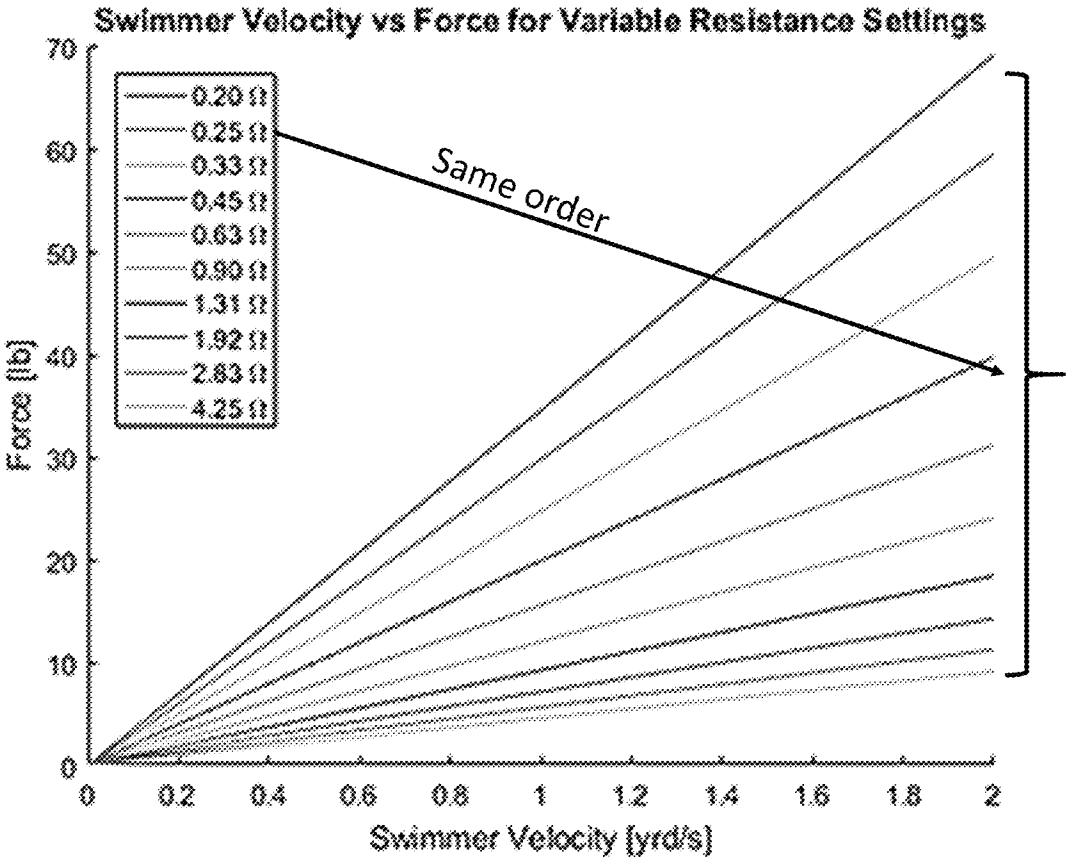
FIG. 9 is a graph of force (in lb) vs. a swimmer velocity based on application of various resistance values of the variable resistance shown in FIG. 8.

The resistor bank was sized using Ohm's Law, the back electromotive force caused by the motor turning, and the current needed to produce the maximum torque output. Changing the size of the potentiometer (shown as R1), FIG. 9 shows the trainee loads (e.g., a swimmer) versus velocity for different resistance settings.

The spool was sized to prevent variation in the effective diameter of the spool as the amount of rope/cable coiled around it increased. In one embodiment, to avoid entanglement the spool should be sized such that it can be wound with no more than one layer of rope/cable coil around at any given part. In other embodiments, the rope/cable is allowed to be reeled based on multiple layers.

Figure 10:
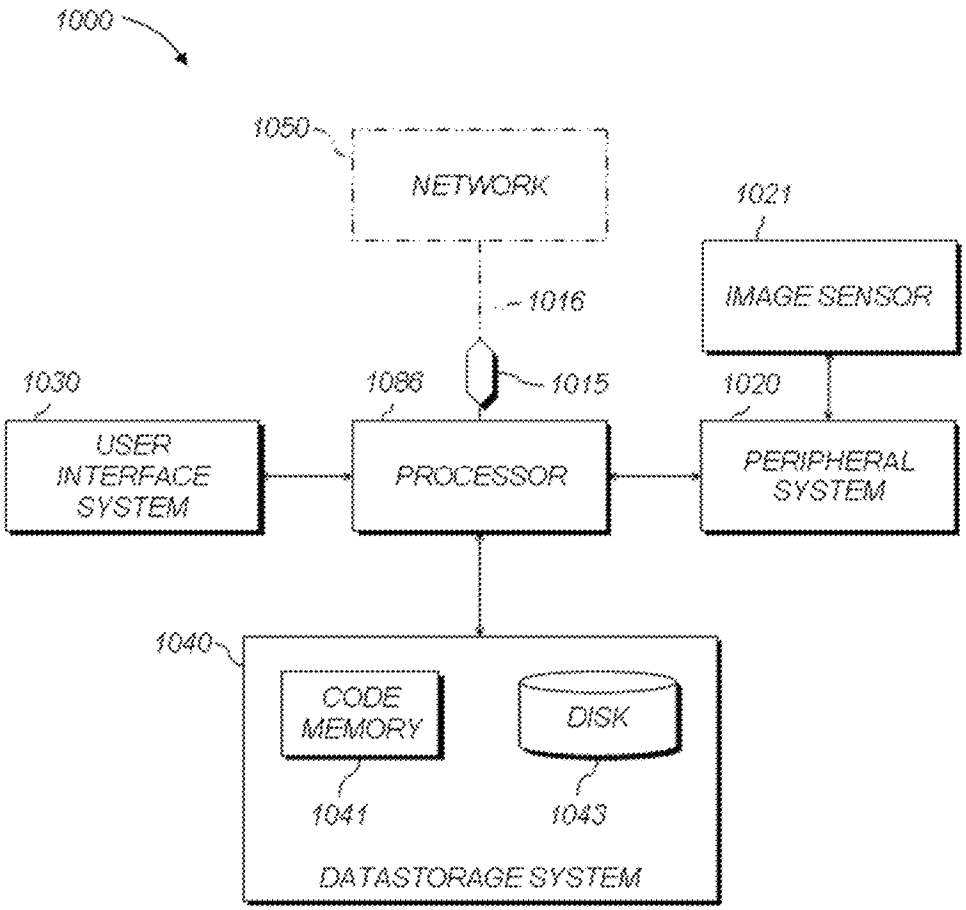
FIG. 10 is a high-level diagram showing the components of an exemplary data-processing system for analyzing data and performing other analyses described herein, and related components.

Referring to FIG. 10, a high-level diagram showing the components of an exemplary data-processing system (also referred herein to as computer system) 1000 for analyzing data and performing other analyses described herein, and related components. The system includes a processor 1086, a peripheral system 1020, a user interface system 1030, and a data storage system 1040. The peripheral system 1020, the user interface system 1030 and the data storage system 1040 are communicatively connected to the processor 1086. Processor 1086 can be communicatively connected to network 1050 (shown in phantom), e.g., the Internet or a leased line, as discussed below. The imaging described in the present disclosure may be obtained using imaging sensors 1021 and/or displayed using display units (included in user interface system 1030) which can each include one or more of systems 1086, 1020, 1030, 1040, and can each connect to one or more network(s) 1050. Processor 1086, and other processing devices described herein, can each include one or more microprocessors, microcontrollers, field-programmable gate arrays (FPGAs), application-specific integrated circuits (ASICs), programmable logic devices (PLDs), programmable logic arrays (PLAs), programmable array logic devices (PALs), or digital signal processors (DSPs).

Processor 1086 can implement processes of various aspects described herein. Processor 1086 can be or include one or more device(s) for automatically operating on data, e.g., a central processing unit (CPU), microcontroller (MCU), desktop computer, laptop computer, mainframe computer, personal digital assistant, digital camera, cellular phone, smartphone, or any other device for processing data, managing data, or handling data, whether implemented with electrical, magnetic, optical, biological components, or otherwise. Processor 1086 can include Harvard-architecture components, modified-Harvard-architecture components, or Von-Neumann-architecture components.

The phrase "communicatively connected" includes any type of connection, wired or wireless, for communicating data between devices or processors. These devices or processors can be located in physical proximity or not. For example, subsystems such as peripheral system 1020, user interface system 1030, and data storage system 1040 are shown separately from the data processing system 1086 but can be stored completely or partially within the data processing system 1086.

The peripheral system 1020 can include one or more devices configured to provide digital content records to the processor 1086. For example, the peripheral system 1020 can include digital still cameras, digital video cameras, cellular phones, or other data processors. The processor 1086, upon receipt of digital content records from a device in the peripheral system 1020, can store such digital content records in the data storage system 1040.

The user interface system 1030 can include a mouse, a keyboard, another computer (connected, e.g., via a network or a null-modem cable), or any device or combination of devices from which data is input to the processor 1086. The user interface system 1030 also can include a display device, a processor-accessible memory, or any device or combination of devices to which data is output by the processor 1086. The user interface system 1030 and the data storage system 1040 can share a processor-accessible memory.

In various aspects, processor 1086 includes or is connected to communication interface 1015 that is coupled via network link 1016 (shown in phantom) to network 1050. For example, communication interface 1015 can include an integrated services digital network (ISDN) terminal adapter or a modem to communicate data via a telephone line; a network interface to communicate data via a local-area network (LAN), e.g., an Ethernet LAN, or wide-area network (WAN); or a radio to communicate data via a wireless link, e.g., WiFi or GSM or other cellular modalities. Communication interface 1015 sends and receives electrical, electromagnetic or optical signals that carry digital or analog data streams representing various types of information across network link 1016 to network 1050. Network link 1016 can be connected to network 1050 via a switch, gateway, hub, router, or other networking device.

Processor 1086 can send messages and receive data, including program code, through network 1050, network link 1016 and communication interface 1015. For example, a server can store requested code for an application program (e.g., a JAVA applet) on a tangible non-volatile computer-readable storage medium to which it is connected. The server can retrieve the code from the medium and transmit it through network 1050 to communication interface 1015. The received code can be executed by processor 1086 as it is received, or stored in data storage system 1040 for later execution.

Data storage system 1040 can include or be communicatively connected with one or more processor-accessible memories configured to store information. The memories can be, e.g., within a chassis or as parts of a distributed system. The phrase "processor-accessible memory" is intended to include any data storage device to or from which processor 1086 can transfer data (using appropriate components of peripheral system 1020), whether volatile or non-volatile; removable or fixed; electronic, magnetic, optical, chemical, mechanical, or otherwise. Exemplary processor-accessible memories include but are not limited to: registers, floppy disks, hard disks, tapes, bar codes, Compact Discs, DVDs, read-only memories (ROM), erasable programmable read-only memories (EPROM, EEPROM, or Flash), and random-access memories (RAMs). One of the processor-accessible memories in the data storage system 1040 can be a tangible non-transitory computer-readable storage medium, i.e., a non-transitory device or article of manufacture that participates in storing instructions that can be provided to processor 1086 for execution.

In an example, data storage system 1040 includes code memory 1041, e.g., a RAM, and disk 1043, e.g., a tangible computer-readable rotational storage device such as a hard drive. Computer program instructions are read into code memory 1041 from disk 1043. Processor 1086 then executes one or more sequences of the computer program instructions loaded into code memory 1041, as a result performing process steps described herein. In this way, processor 1086 carries out a computer implemented process. For example, steps of methods described herein, blocks of the flowchart illustrations or block diagrams herein, and combinations of those, can be implemented by computer program instructions. Code memory 1041 can also store data, or can store only code.

Various aspects described herein may be embodied as systems or methods. Accordingly, various aspects herein may take the form of an entirely hardware aspect, an entirely software aspect (including firmware, resident software, micro-code, etc.), or an aspect combining software and hardware aspects. These aspects can all generally be referred to herein as a "service," "circuit," "circuitry," "module," or "system."

Furthermore, various aspects herein may be embodied as computer program products including computer readable program code stored on a tangible non-transitory computer readable medium. Such a medium can be manufactured as is conventional for such articles, e.g., by pressing a CD-ROM. The program code includes computer program instructions that can be loaded into processor 1086 (and possibly also other processors), to cause functions, acts, or operational steps of various aspects herein to be performed by the processor 1086 (or other processor). Computer program code for carrying out operations for various aspects described herein may be written in any combination of one or more programming language(s), and can be loaded from disk 1043 into code memory 1041 for execution. The program code may execute, e.g., entirely on processor 1086, partly on processor 1086 and partly on a remote computer connected to network 1050, or entirely on the remote computer.

Additional disclosure is found in Appendix—A, filed herewith, including a source code for a one-pull system embodiment as well as other mathematical formulas, the contents of which are incorporated by referenced in its entirety into the present disclosure.

Those having ordinary skill in the art will recognize that numerous modifications can be made to the specific implementations described above. The implementations should not be limited to the particular limitations described. Other implementations may be possible.

The invention claimed is:

1. A swimming strength and endurance training system, comprising:

a first assist-resist system disposed at a first longitudinal end of a swimming pool in a stationary manner, including:

a first housing;

a first motor disposed in the first housing that is activated and deactivated by a first motor controller;

a first spool disposed in the first housing and coupled to the first motor;

a first connecting member having a second end coupled to the first spool and configured to be coiled around the first spool and extending out of the first housing;

a coupling device coupled to a first end of the first connecting member, wherein the coupling device is attachable to a harness configured to be worn by a swimmer;

a second assist-resist system disposed at a second longitudinal end of the swimming pool opposite the first longitudinal end in a stationary manner, including:

a second housing positioned opposite the first housing;

a second motor disposed in the second housing that is activated and deactivated by a second motor controller;

a second spool disposed in the housing and coupled to the second motor; and a second connecting member having a second end coupled to the second spool and a first end coupled to the coupling device and configured to be coiled around the second spool and extending out of the second housing; and a computer system configured to use as input one or more of i) a measurement of distance of the coupling device from the first assist-resist system and the second assist-resist system, ii) a predetermined strength value, and iii) a measurement of external force applied to the coupling device, wherein the computer system is configured to operate the first assist-resist system and the second assist-resist system in concert with one-another in all a resistive mode, an assistive mode and a bypass mode, wherein i) the resistive mode is defined when a resistive force is applied to the coupling device when the coupling device moves away from one of the first assist-resist system and the second assist-resist system, ii) the assistive mode is defined when an assistive force is applied to the coupling device when the coupling device moves towards one of the first assist-resist system and the second assist-resist system, and iii) the bypass mode is defined when a negligible force (about 0 N-about 5 N) is applied to the coupling device.

2. The system of claim 1, wherein the resistive mode is generated by application of one or more of: i) a mechanical braking system to one of the first and second motors by engaging mechanical brakes; ii) a passive braking system by engaging electrical energy consuming devices to one of the first and second motors; iii) an electrical energy recovery system by engaging an electrical energy storage device to one of the first and second motors; iv) a mechanical energy recovery system by engaging a mechanical energy storage device to one of the first and second motors; and v) by applying electrical current to one of the first and second motors in a direction that opposes the movement of the coupling device away from the first assist-resist system.

3. The system of claim 1, wherein the assistive mode is by application of one of: i) applying electrical current to one of the first and second motors in a direction that assist the movement of the coupling device, wherein the electrical current can be sourced from an electrical outlet, a battery, a capacitor, or other electrical storage devices; and ii) recovering mechanical energy by engaging a mechanical energy storage device to the first motor to convert storage mechanical energy.

4. The system of claim 1, wherein the first housing is affixed to a position using one or more weights.

5. The system of claim 1, wherein the first spool is coupled to a first barrel cam configured to coil the connecting member around the first spool.

6. A method of providing swimming strength and endurance training, comprising:

providing a first assist-resist force to a coupling device that is attachable to a swimmer by a first assist-resist system disposed at a first longitudinal end of a swimming pool in a stationary manner and coupled to the coupling device via a first connecting member;

providing a second assist-resist force to the coupling device by a second assist-resist system disposed at a second longitudinal end of the swimming pool opposite the first longitudinal end in a stationary manner and also coupled to the coupling device via a second connecting member; and controlling the first assist-resist system and the second assist-resist system by a computer system configured to use as input one or more of i) a measurement of distance of the coupling device from the first assist-resist system and the second assist-resist system, ii) a predetermined strength value, and iii) a measurement of external force applied to the coupling device by the individual and thus operate the first assist-resist system and the second assist-resist system in concert with one-another in all a resistive mode, an assistive mode and a bypass mode, wherein i) the resistive mode is defined when a resistive force is applied to the coupling device when the coupling device moves away from one of the first assist-resist system and the second assist-resist system, ii) the assistive mode is defined when an assistive force is applied to the coupling device when the coupling device moves towards one of the first assist-resist system and the second assist-resist system, and iii) a bypass mode defined when a negligible force (about 0 N-5 N) is applied to the coupling device.

7. The method of claim 6, wherein the resistive mode is generated by application of one or more of: i) mechanical braking applied to one of the first assist-resist system and the second assist-resist system; ii) passive braking system by engaging an electrical energy consuming device to one of the first assist-resist system and the second assist-resist system; iii) an electrical energy recovery system by engaging an electrical energy storage device to one of the first assist-resist system and the second assist-resist system; iv) a mechanical energy recovery system by engaging a mechanical energy storage device to one of the first assist-resist system and the second assist-resist system; and v) by applying electrical current to one of the first assist-resist system and the second assist-resist system in a direction that opposes the movement of the coupling device away from one of the first assist-resist system and the second assist-resist system.

8. The method of claim 6, wherein the assistive mode is by one of: i) applying electrical current to one of the first assist-resist system and the second assist-resist system in a direction that assist the movement of the coupling device, wherein the electrical current can be sourced from an electrical outlet, a battery, a capacitor, or other electrical storage devices; and ii) recovering mechanical energy by engaging a mechanical energy storage device to one of the first assist-resist system and the second assist-resist system to convert storage mechanical energy.

9. The method of claim 6, wherein the first assist-resist system is affixed to a position using one or more weights.

10. The method of claim 6, wherein the first connecting member is coiled around a first spool utilizing a first barrel cam.

* * * * *